United States Patent [19]

Edwards et al.

[11] Patent Number: 4,603,740

[45] Date of Patent: Aug. 5, 1986

[54] SUBSURFACE SAFETY VALVE

[75] Inventors: Jon L. Edwards; Mark L. Carter, both of Houston, Tex.

[73] Assignee: Hydril Company, Los Angeles, Calif.

[21] Appl. No.: 645,408

[22] Filed: Aug. 29, 1984

[51] Int. Cl.[4] ..... E21B 34/10

[52] U.S. Cl. ..... 166/319; 166/323; 277/124

[58] Field of Search ..... 166/319–321, 166/323, 332, 334, 386, 387, 373; 277/58, 61, 63, 124, 188 R, 188 A

[56] References Cited

U.S. PATENT DOCUMENTS

| | | | |
|---|---|---|---|
| 2,525,747 | 10/1950 | Hess | 277/124 |
| 3,519,280 | 7/1970 | Genz | 277/124 |
| 3,821,962 | 7/1974 | Mott | 166/323 X |
| 3,882,935 | 5/1975 | Calhoun | 166/323 X |
| 3,896,876 | 7/1975 | Crowe | 166/321 X |
| 3,901,321 | 8/1975 | Mott | 166/321 X |
| 4,077,473 | 3/1978 | Watkins | 166/323 |

*Primary Examiner*—Stephen J. Novosad
*Assistant Examiner*—Thuy M. Bui
*Attorney, Agent, or Firm*—Dodge, Bush & Moseley

[57] ABSTRACT

A tubing retrievable surface controlled subsurface safety valve having a rotatable ball-type flow closure element is disclosed. A tubular operator assembly imparts longitudinal movement to the ball greater than the predetermined movement required to effect the desired ball rotation. The ball element is normally maintained by a closing spring arrangement and is rotated open by increased control fluid pressure. Camming slides on the ball rotation pins reduce contact stress during ball operation.

A locking sleeve having a longitudinal locking movement greater than the predetermined movement to rotate the ball open is provided. Operating movement of the locking sleeve uncovers a control fluid port for operating a supplemental subsurface valve operably secured with the valve. Prior to activating the locking sleeve to install the supplemental valve, the valve may be controlled by control fluid pressure communicated into an expansible chamber. The chamber is formed by two pairs of seals located on different diameters and at opposite ends of an operator sleeve guide member. The guide member contains both pairs of seals against extrusion from extreme pressure differentials. The seals are pressure energized and the seals of each pair are faced in opposite directions to maintain sealing integrity under all pressure differential operative conditions.

6 Claims, 11 Drawing Figures

FIG. 3
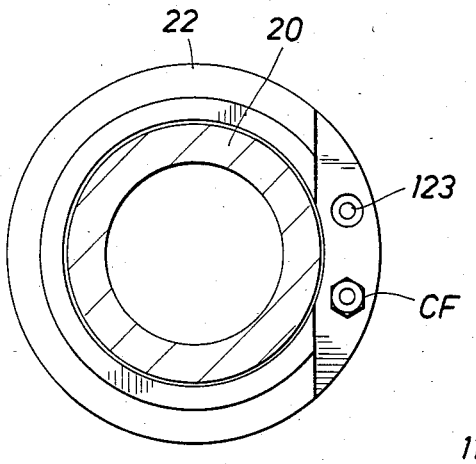
FIG. 5
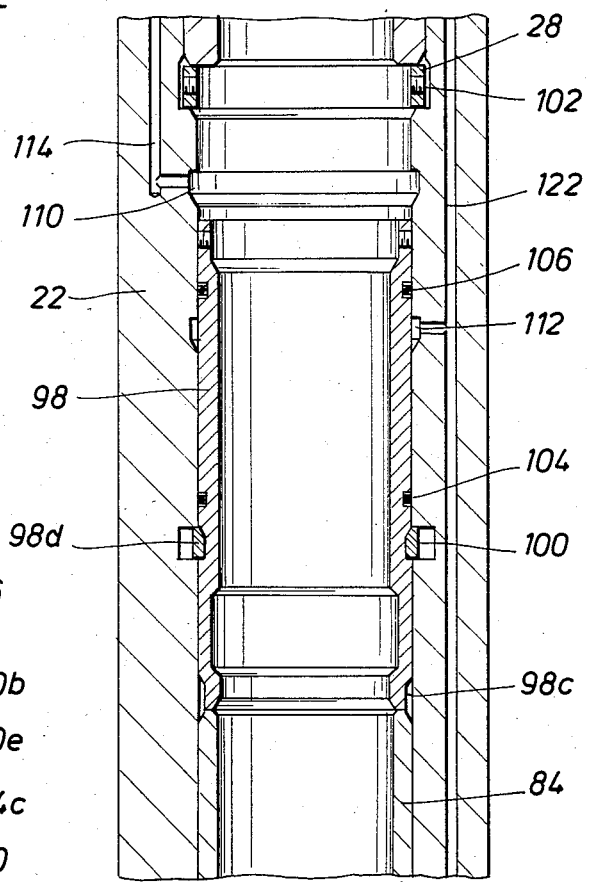
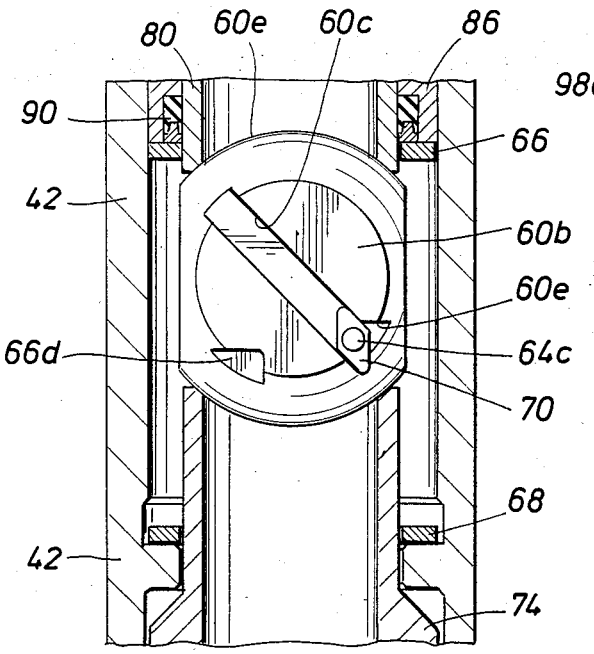
FIG. 4

SUBSURFACE SAFETY VALVE

BACKGROUND OF THE INVENTION

Field of the Invention

The present invention relates broadly to the field of safety systems for use in controlling undesired flow of well fluids from hydrocarbon producing wells. Specifically, the present invention relates to an improved simplified construction of a rotatable ball-type surface controlled tubing retrievable subsurface safety valve which is designed for ease of assembly and operation and with protected fluid seals.

Cross-Reference to Related Application

The present application is related to co-pending application, Ser. No. 539,333, filed Oct. 5, 1983, entitled "Subsurface Safety Valve" and naming Fred Wong and Larry Graham as inventors and now U.S. Pat. No. 4,552,219. The assignee of the present invention, Hydril Company, is also the owner of application Ser. No. 539,333.

Description of the Prior Art

Surface controlled subsurface valves used as safety systems to control flow of well fluids from hydrocarbon producing wells are known. Some early examples of such subsurface valves and the well safety systems they have provided are disclosed in the following patents which are also assigned to the assignee of the present invention:

| Patentee | U.S. Pat. No. | Issue Date |
|---|---|---|
| Knox | 2,518,795 | August 15, 1950 |
| Knox | 3,035,808 | May 22, 1962 |
| Lewis | 3,509,913 | May 5, 1970 |

Generally such safety valves were of the tubing retrievable type with the tubular valve housing made-up in and forming a portion of the well tubing and therefore retrievable with the well tubing. The quick acting ball-type closure element with its desirable full opening and straight through flow passage characteristics was disclosed in the Knox '808 patent.

A detailed discussion of the subsurface safety valve prior art is found in the following selected U.S. patents which are also assigned to the assignee of the present invention:

| Patentee | U.S. Pat. No. |
|---|---|
| Mott | 3,901,321 |
| Mott | 3,993,136 |
| Mott | 4,019,574 |
| Mott | 4,026,362 |

All of the seven above identified patents, as well as any other patent subsequently identified herein, are hereby fully incorporated herein as written description by this specific reference for any and all purposes as completely as if such patent was set forth verbatim herein.

In addition to the previously selected and identified patents, applicant's assignee is also the owner of numerous additional patents and patent applications disclosing well safety systems and components therefor. Many other inventors have also been active in developing this useful technology as will be considered hereinafter. It is to be understood that other patents not mentioned herein may be as equally relevant as prior art to those that are mentioned, but that best efforts have been made to identify and consider the best prior art.

U.S. Pat. No. 2,998,077 to Keithahn is entitled "Subsurface Safety Shut-Off Valve Apparatus". The disclosed tubing retrievable surface control subsurface safety valve employs a modified ball-type flow closure element which may be locked in the open position using a wire-line tool to shift a radially expandable locking detent. No provision for installation of a back-up valve is made in the Keithahn disclosure. See also Mott Canadian Pat. No. 955,915 originally filed as U.S. patent application Ser. No. 72,034 on Sept. 14, 1970 and as U.S. Pat. No. 4,550,780 which discloses a releasable locking means and a back-up valve capability.

U.S. Pat. No. Re. 28,131 (originally U.S. Pat. No. 3,741,249) names Kurt Leutwyler as inventor and is entitled "Ball Valve With Resilient Seal". Each chordal flat formed on the ball-type flow closure element is provided with a radial recess for receiving the eccentric rotation crank pin and a lug defining a pair of rotational movement limit stop shoulders for engaging the reciprocating ball cage member. By engaging the ball cage member with the stops, the ball is prevented from rotational overtravel in response to ball longitudinal movement greater than that required for rotation. The stops which engage or co-act with the movable cage to insure that the ball is held in the aligned full opening position rather than partially open position creating a flow throttling impingement and resulting valve damaging erosion.

Crowe U.S. Pat. No. 3,771,603 is entitled "Dual Safety Valve Method And Apparatus". The disclosed arrangement for limiting rotational travel of the two parallel flow path ball closure elements in a dual completion well is substantially identical to that of related U.S. Pat. No. 3,896,876 to be discussed hereinafter.

Crowe U.S. Pat. No. 3,850,242 entitled "Subsurface Safety Valve" is stated to be related to both U.S. Pat. Nos. 3,797,573 and 3,771,603. The mounting and rotational travel limits of the ball are provided by a pair of stop shoulders formed on each of the ball chordal flats in a manner similar to that of U.S. Pat. No. Re. 28,131. A non-releasable wire-line actuated lockout sleeve is provided in the tubing retrievable valve for permanently locking the valve open. Shifting of the lockout sleeve by wire-line operations to effect locking also communicates the control fluid pressure into the bore of the well tubing for operating the supplemental subsurface safety valve.

Crowe U.S. Pat. No. 3,868,995 entitled "Sub-Surface Safety Valve" discloses the use of a split ball flow closure element to equalize well fluid pressure before ball opening rotation begins. The ball rotational limit stop is also formed on each ball flat by a lug or projection forming the desired stop shoulders. Both a concentric ball mounting pin receiving recess and a radially extending eccentric crank pin receiving recess are formed on each ball flat.

Crowe U.S. Pat. No. 3,896,876 also discloses a ball closure mounting having an eccentric pin radial slot and rotational limit shoulders formed in each chordal flat of the ball. A lockout sleeve is provided in the tubing retrievable valve for enabling the ball-type closure element to be permanently locked in the open position.

Shifting of the locking sleeve also enables communication of the control fluid pressure to the wire-line retrievable valve in a manner similar to U.S. Pat. No. 3,850,242.

U.S. Pat. No. 3,971,438 also names Crowe as inventor and is entitled "Wire-line Safety Valve With Split Ball". The disclosed valve also uses a two piece ball to equalize the fluid pressure prior to rotating the ball open. Each chordal flat of the ball closure element has a central or concentric recess for receiving a longitudinally movable pin on the reciprocating valve operator and a radial slot for receiving an eccentric ball crank pin mounted on the valve housing. Longitudinal movement of the valve operator relative to the valve body moves the ball relative to the fixed eccentric pin to crank the ball between the open and closed position. Raised lugs 114 on the ball flats engage the operator mechanism to maintain the fully aligned ball open position when the valve operator travels downwardly a longitudinal distance greater than that required to rotate the ball open.

U.S. Pat. No. 3,763,932 to Dinning is entitled "Surface Operated, Subsurface Safety Valve Assembly". The flapper-type closure tubing retrievable subsurface safety valve is adapted to be locked open by wireline operations and a wireline flapper-type retrievable valve installed therein for back-up operation. To establish communication between the control fluid operating chamber and the bore of the tubing retrievable valve to enable controlled operation of the back-up valve it was necessary to perforate the operator sleeve.

U.S. Pat. No. 3,078,923 to Tausch discloses a wireline retrievable surface control subsurface safety valve having a flapper-type flow closure and carrying the control fluid pressure responsive mechanism. The valve is disclosed as being operably received in a conventional landing nipple.

U.S. Pat. No. 3,627,042 discloses the use of a side pocket mandrel as a tubing retrievable housing for operably receiving a wireline retrievable flapper-type subsurface safety valve having control fluid pressure responsive surfaces.

Tausch U.S. Pat. No. 3,786,863 is entitled "Well Safety Valve System". A wireline actuated valve mechanism is installed in the well tubing adjacent a conventional landing nipple. The control fluid conduit is run from the surface to the valve mechanism and then to the landing nipple. Prior to retrieving the wireline retrievable safety valve in the landing nipple, the valve mechanism is closed to prevent escape of the hydraulic control fluid from the control fluid conduit when the wire-line valve is removed from the landing nipple. See also Krause U.S. Pat. No. 4,249,599.

U.S Pat. No. 3,786,865 to Tausch is entitled "Lockout For Well Safety Valve". The disclosed tubing retrievable valve lockout sleeve is located below the flapper closure element and is shifted upwardly by a wire-line operation to hold the flapper in the open position.

U.S. Pat. No. 3,786,866 is also "Lockout For Well Safety Valve" and discloses two embodiments of a tubing retrievable valve. Telescoping portions of the operator sleeve may be extended to lock the flapper open.

Tausch U.S. Pat. No. 3,786,867 is entitled "Well Safety Valve System And Method Of Operation". The disclosed invention provides a drain valve operated by wireline for removing liquid from the control fluid conduit. The absence of liquid in the control fluid conduit avoids the effect of a hydrostatic head on the valve and thereby installation at a greater depth in the well. Pressurized gas is used as a control fluid in the conventional manner to operate the valve.

Watkins U.S. Pat. No. 3,799,204 discloses an equalizing valve actuated by a lost motion linkage of the valve operator. The initial movement of the operator opens the equalizing valve to eliminate the pressure differential across the primary flapper closure element prior to attempting to open the flapper.

U.S. Pat. No. 3,799,258 is entitled "Subusrface Well Safety Valve". The disclosed surface controlled tubing retrievable subsurface valve as well as the wireline retrievable backup valve employ flapper-type closure elements for controlling flow. The tubing retrievable valve is equipped with a shear pin retained lockout sleeve which also closes a control fluid port. When sheared, the sleeve locks the tubing retrievable valve open and communicates the control fluid to the back-up valve installed in the bore of the tubing retrievable valve.

U.S. Pat. No. 4,077,473 is entitled "Well Safety Valve" and is similar to U.S. Pat. No. 3,981,358. The flapper-type tubing retrievable valve incorporates a mechanism for resetting the tubular operator to the proper operating length after a prearranged telescopic collapse due to the well shut-in pressure differential opposing opening movement of the flapper element.

Bostock U.S. Pat. No. 2,894,715 discloses a tubing retrievable surface control subsurface safety valve in which the ball flow closure element does not move longitudinally in rotating to and from the open and closed positions. Rotation is effected by a radial lug on each ball flap received within a slot formed on the reciprocating operator.

Fredd U.S. Pat. No. Re. 25,471 (originally U.S. Pat. No. 3,007,669) discloses a number of embodiments of a ball valve in which the ball flow closure element having a flow port formed therethrough moves longitudinally during rotational operation. Each of the two parallel chordal flats formed on the rotatable ball has a cam slot extending radially across the flat. A first cam lug on the reciprocating operator and a second cam lug fixed to the tubular valve body are operably positioned in each slot. The fixed cam lugs include pivots surrounded by rotatable blocks which provide large bearing surfaces in the cam slots to better distribute the stresses created during valve operation. The operator cam lugs have rotatable rollers which engage opposite sides of the cam slots for enabling the greater sliding motion of the operator cam lugs effecting the longitudinal movement of the ball needed to provide operating rotation.

U.S. Pat. No. Re. 26,149 discloses a conventional tubing landing nipple having a separate control fluid conduit extending to the surface. A wireline retrievable valve operably positioned in the landing nipple receives control fluid pressure from the surface for controlling operation of the wireline retrievable valve. The control fluid is communicated to a pressure responsive surface provided on the valve for effecting surface controlled valve operation. Both a sleeve valve and a geared double flapper valve is disclosed for wireline installation in the landing nipple.

A ball-type wireline retrievable valve having pressure responsive means for installation in a landing nipple is disclosed in Grimmer et al. U.S. Pat. No. 3,292,706. A fluid pressure operated wireline retrievable subsurface safety valve is also disclosed in Bostock U.S. Pat. No. 3,002,566.

A surface control manifold for a subsurface safety valve is disclosed in Tamplen et al. U.S. Pat. No. 2,998,070. Typical surface controls are also disclosed in U.S. Pat. Nos. 3,419,076 and 3,675,720. See also U.S. Pat. No. 4,082,147.

U.S. Pat. No. 2,973,005 is entitled "Ball-Type Surface Safety Valve" in which the ball valve mechanism moves longitudinally in order to effect rotation of the ball member.

Taylor U.S. Pat. No. 3,642,070 discloses a wireline retrievable ball-type valve for landing in conventional landing nipples using the locating and locking mandrel described in Tamplen U.S. Pat. No. 3,208,531. The ball is supported from a pair of oppositely disposed support brackets having mounting pins which are received within concentric openings formed on each of the two ball flats. The eccentric operator pins are fixed to the housing for effecting rotation of the ball while ball alignment pins are employed to prevent rotation of the support brackets during ball rotation.

U.S. Pat. No. 3,233,860 is entitled "Ball Valve Improvement". The valve operator sleeves above and below the ball are operably connected so that only a portion of the force required for effecting rotation of the ball is transmitted through engagement with the ball member.

U.S. Pat. No. 3,310,114 is entitled "Pressure Operated Safety Valve". The disclosed valve employs a rotatable ball member having concentric mounting pins received in the concentric recess of the ball. A pair of eccentric pins rigidly secured to the valve housing engage radially extending slots formed in the ball flats for providing the cranking or rotational movement. The connector members holding the ball for rotation are held against relative circumferential rotation by a pair of fixed pins.

U.S. Pat. No. 2,908,330 discloses a valve having a ball-type closure element movable from the open to the closed position but which may not be reopened in the well. The ball element is provided with eccentric pins which move in correspondng cam tracks to effect this one time operation.

Taylor, Jr. U.S. Pat. No. 3,696,868 discloses a surface controlled tubing retrievable ball-type subsurface safety valve which may be locked open using a wireline tool to shift a locking sleeve positioned above the upper valve operator sleeve. The valve lock open may be either permanent or releasable depending upon the disclosed embodiment employed. The tubing retrievable valve is also provided with an equalizing valve arrangement such as disclosed in Dollison U.S. Pat. No. 3,583,442 to prevent opening of the ball with a potentially damaging pressure differential formed across the flow closure element. The ball closure element is concentrically mounted by a pair of longitudinally movable pins and cranked to the open position by a pair of fixed eccentric pins. A third set of pins are employed to prevent rotation of the concentric mounting fingers of the operator assembly. A second hydraulic control fluid conduit is disclosed for balancing or offsetting the hydrostatic head of the hydraulic control fluid in the conventional operating control fluid conduit if desired. A supplemental or wireline retrievable valve may be installed in the locked open tubing retrievable valve and operated by the hydraulic fluid control of the tubing retrievable valve to provide a back-up safety system. Fluid communication between the hydraulic control fluid conduit and the pressure responsive operating mechanism of the valve is established by either perforating the upper operator of the locked open valve or by providing a port associated with the locking sleeve if desired. Details of the ball mounted linkage are stated to be disclosed in U.S. Pat. No. 3,583,442 to Dollison. The packoff tool or mounting housing for the supplemental subsurface safety valve are said to be disclosed in Tamplen U.S. Pat. No. 3,208,531. If a supplemental valve is used it is such that is disclosed in Dollison U.S. Pat. No. 3,583,442.

Taylor U.S. Pat. No. 3,826,462 is entitled "Large Bore Rotary Safety Valves For Wells". The disclosed valve is of a wireline type carrying the control fluid pressure responsive mechanism and having windows formed in the housing to provide clearance for operating rotation of the large diameter ball element. See also Mott U.S. Pat. No. 4,067,387.

U.S. Pat. No. 3,860,066 discloses a tubing retrievable safety valve having alternate flow closure elements. A poppet-type closure element, a flapper type closure element and a ball type closure element are disclosed as functionally interchangeable flow control elements. The operating or actuating mechanism for the disclosed valves are provided with remote or surface controls as well as with direct well condition responsive means.

Gazda U.S. Pat. Nos. 3,874,634 and 3,990,511 disclose a tubing retrievable surface controlled subsurface safety valve having a sliding sleeve internal valve which controls communication between the interior of the tubing retrievable valve and the control fluid pressure communicated from the surface through the a separate control line. The sliding sleeve valve is opened and closed automatically as the wire-line or through the flow line movable safety valve is installed in or removed from the safety valve.

U.S. Pat. No. 3,882,935 to Calhoun is entitled "Subsurface Safety Valve With Auxiliary Control Fluid Passage Operable In Response To An Increase In Control Fluid Pressure". The primary tubing retrievable surface controlled subsurface safety valve may be locked open in a manner similar to Taylor U.S. Pat. No. 3,696,868. Shearable seal plugs are employed to normally seal the control fluid pressure system from the flow passage of the tubing retrievable valve. By pressuring the control fluid pressure above the normal operating range, the plugs shear out to establish a control fluid path to the flow passage and the supplemental valve operably positioned therein. In one alternate embodiment, a rupture disk, actuated by shifting of the locking sleeve, is employed to establish to communication of the control fluid. Another embodiment equalizes control fluid pressure across the shear plug or ruptured disk until the lock sleeve is shifted to preclude an inadvertent, premature activation of the control fluid passage to the supplemental valve. In a fourth embodiment, a port formed in the locking sleeve is shifted into communication with a control fluid port to form the flow passage.

The disclosed safety valve of U.S. Pat. No. 4,193,450 is entitled "Surface Controlled Subsurface Safety Valve" and is of the through-the-flow line (TFL) type carrying the control pressure responsive means and adapted to be operably secured in a dual line landing nipple. The various operating fluid pressure zones are arranged to provide for valve closure (fail-safe operation) in the event of a seal failure. The disclosed landing nipple is stated to be the subject matter of a co-pending patent application, Ser. No. 960,169.

SUMMARY OF THE INVENTION

The present invention relates to a new and improved subsurface safety valve system for use in hydrocarbon producing wells and particularly to a primry tubing retrievable surface controlled subsurface safety valve. The rotatable ball flow closure element is rotated to and from the open and closed position by longitudinal movement of a prearranged distance and is prevented from over rotation by additional longitudinal movement after desired rotation is achieved by coacting stops. The ball-type flow closure element is mormally maintained in the closed upper position by a spring biasing arrangement to provide failsafe operation. When it is desired to open the valve and enable flow through the well tubing, pressure of control fluid communicated to the valve from the surface through a separate control fluid conduit is increased to overcome the spring biasing to move the ball longitudinally to the lower or rotated open position. When desired, the ball may be locked in the open position by shifting a locking sleeve using wire-line operations. The shifted locking sleeve maintains the valve actuator in the lower position to hold the ball in the open position and unseals a flow port to enable communication of control fluid to the flow passage and a supplemental safety valve operably installed therein.

For ease of assembly and economy of construction the tubular valve housing is formed of relatively short tubular sections threadedly connected in concentric relationship. This arrangement provides for simplified and rapid maintenance if needed.

To enhance and extend operating life the control fluid expansible operating chamber is sealed with dual facing back-to-back pressurized seals. Each of the pressure energized seals is protected from extrusion by either high temperature or high pressure operating conditions with a seal back up ring.

The ball-type closure element is rotated by fixed eccentric pins which rotatably carry a camming lug. The camming lugs slides in slots disposed on opposite sides of the ball during operation. The camming lugs provide a relatively large bearing surface against the slots to reduce stress level between the ball and eccentric pins during operating movement of the ball. The lower stress levels increase the reliability of proper valve operation.

BRIEF DESCRIPTION OF THE DRAWINGS

FIG. 3 is taken along line 3—3 of FIG. 1A;

FIG. 4 is a view of the operating relation of the ball slot and the eccentric camming lugs; and FIG. 5 is a view similar to FIG. 2A with the lock open sleeve shifted to hold the ball in the open position;

DESCRIPTION OF THE PREFERRED EMBODIMENT

Figure 1A:
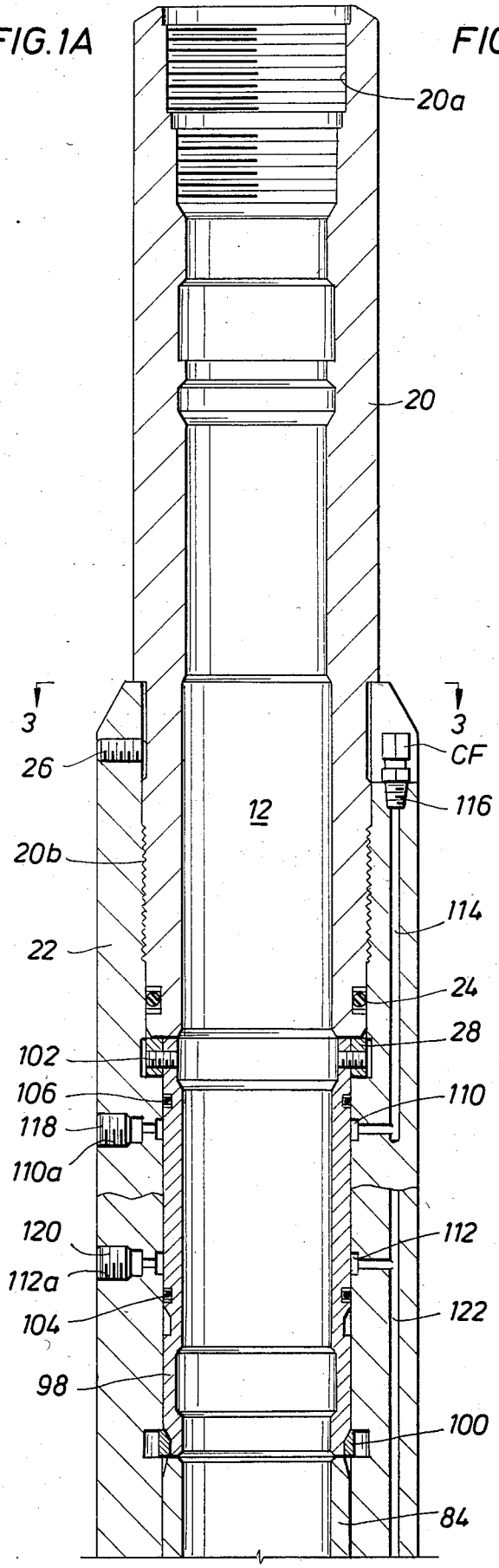
FIGS. 1A, 1B, 1C and 1D are in full section views arranged in alphabetical sequence from top to bottom of a tubing retrievable subsurface safety valve of the present invention in the closed position.

The subsurface safety valve of the present invention, generally designated V, is illustrated in FIGS. 1A, 1B, 1C and 1D commencing from the top of the safety valve V and extending downwardly as would be done when installed in a hydrocarbon producing well (not illustrated). The flow of well fluids, including hydrocarbons, is upwardly through a well flow conduit and the valve to the earth's surface in the conventional manner. The safety valve V provides a catastrophic occurrence protection of the well for shutting in the flow of hydrocarbon well fluids at a preselected location below the earth surface in the event of surface well head equipment malfunction or destruction.

The safety valve V includes a tubing retrievable valve housing or body, generally designated 10, which is connected in and forms a portion of the well conduit or tubing (not illustrated) for providing a central flow passage 12 for conducting the well fluids from the producing formation (not illustrated) to the earth's surface. Reference may be made to Knox U.S. Pat. No. 3,035,808 for an illustration of such an installation including the separate control fluid conduit. A moveable bore closure means, generally designated 14, controls flow through the bore 12 as desired.

The tubular valve housing 10 includes, for ease of assembly, an upper tubular connection sleeve or sub 20 (FIG. 1A), a control fluid pressure sub or upper member 22, an upper body connector sleeve 30 (FIG. 1B), an upper spring or intermediate body member 32, an intermediate body connector sleeve 40 (FIG. 1C), a lower body member 42, a lower spring retainer sleeve 48 (FIG. 1D), and a lower tubing connector sleeve or sub 50. Other arrangements of the valve housing 10 may be employed for ease of assembly without departing from the scope of the present invention.

The upper body tubular member or sub 20 (FIG. 1A) is provided with a conventional internal thread or box connection **20*a* for connecting with the portion of the well conduit above the safety valve V in the usual manner. The upper sub 20 is also provided with threads 20*b* for securing the sub 20 with the tubular sub or control fluid body member 22 in the usual manner during assembly. To prevent leakage of fluid between the upper body member 22 and the upper sub 20 along threads 20*b*, a sealing O-ring 24 is carried by the upper sub 20. If desired, suitable anti-rotational pin 26 may be utilized to prevent inadvertent disengagement of the threads 20*b* in the usual manner. Engagement with a shear pin carrying stop ring 28 limits rotational make-up of the sub 20 into the member 22**.

Figure 1B:
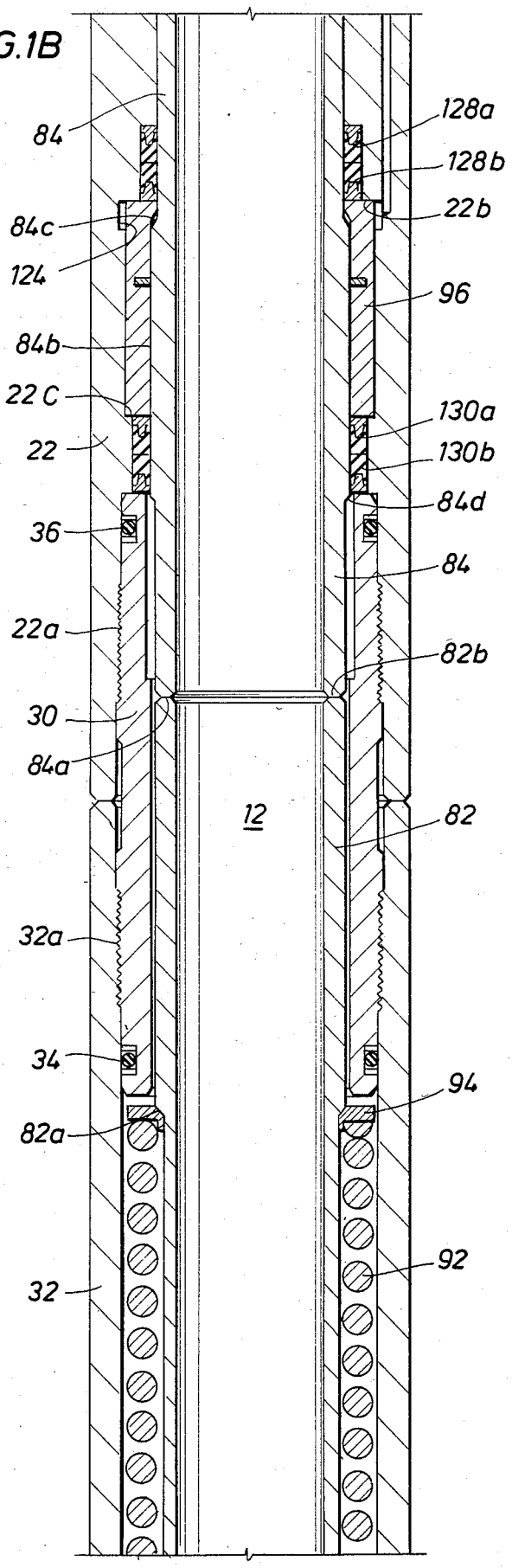

As illustrated in FIG. 1B, the body member 22 is connected to the upper body connector sleeve 30 by threads **22*a*. The upper body connector sleeve 30 is in turn connected to the upper spring sleeve or body member 32 by threads 32*a*. An O-ring 34 prevents leakage of fluid along thread threaded engagement at 32*a* while O-ring 36 maintains leakage integrity of thread threaded engagement at 22*a***.

The upper spring sleeve 32 (FIG. 1C) is assembled in a substantially identical manner to a body connector sleeve 40. Threads **40*a* secure the lower end of the upper spring member 32 to the body connector sub or sleeve 40 while threads 40*b* connect with the body member 42. O-rings 44 and 46 prevent leakage along threads 40*a* and 40*b***, respectively, in the usual manner.

The body sleeve 42 (FIG. 1D) is also assembled in a manner similar to connector sleeve 40 by securing with the lower spring retainer 48 using engaged helical threads **42*a*. Threaded engagement at 48*a* secures the sleeve 48 to the lower body connector sub or sleeve 50. O-rings 52 and 54 seal the lower spring sleeve 48 with the body member 42 and lower connector sub 50 to prevent leakage of fluid therebetween. The lower sub 50 may be provided with suitable threaded connection 50***a* such as a conventional helical pin thread for securing with the portion of the well tubing below the subsurface safety valve V, if desired.

The assembled valve housing 10 thus forms a central flow passageway or full opening bore, generally designated 12, through which well fluids may be communicated or flow substantially unrestricted in the usual manner from the lower sub 50 to the upper sub 20. The full opening bore 12 also enables passage of wire-line tools through the valve V when desired.

Figure 1C:
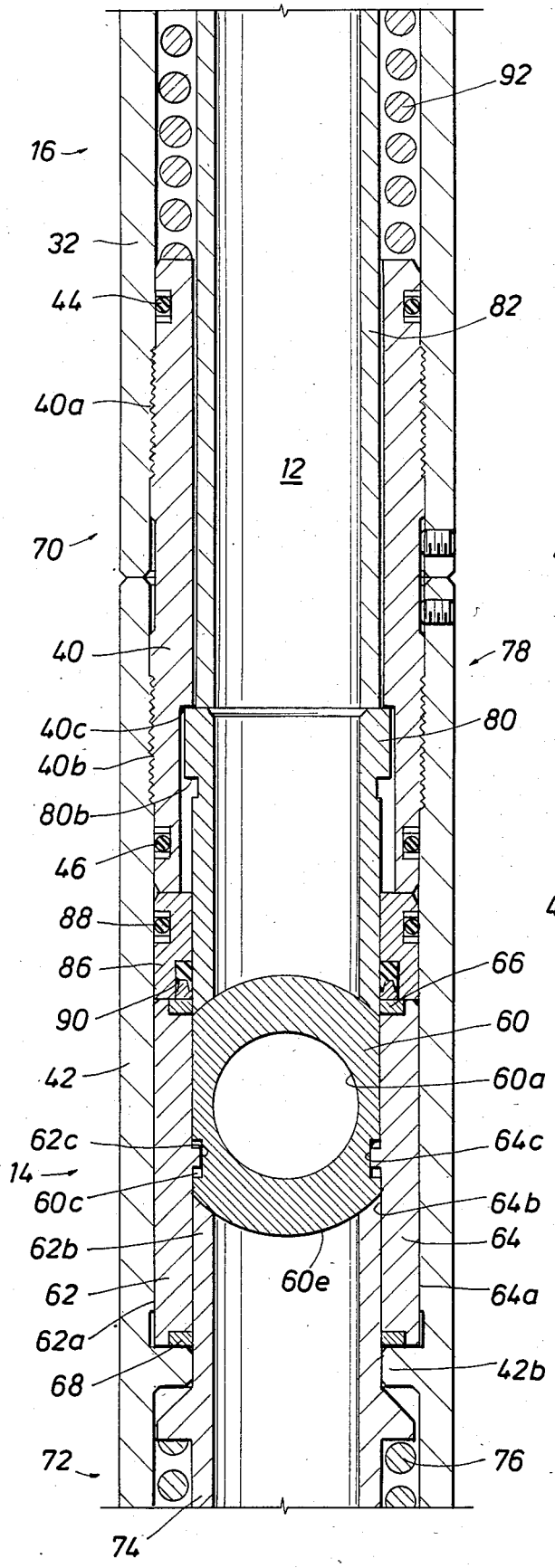

As best illustrated in FIG. 1C, the bore or flow closure means, generally designated 14, is positioned in the bore 12 for movement to and from an open position (FIG. 2C) for enabling flow of fluid through the bore 12 and a closed position (FIG. 1C) for blocking flow of fluid through the bore 12 of the valve V.

The disclosed bore closure means 14 includes a rotatable ball-type closure element 60 and two ball guiding or cage retainer members 62 and 64 which are disposed below the upper spacer ring 66. The spacer ring 66 is disposed between the split ring retainers 62 and 64 and the housing sleeve 40 for preventing both upward and rotational movement of the retainers 62 and 64. An inwardly projecting collar 42*b* on the housing sleeve 30 prevents downward longitudinal movement of the retainers 62 and 64 relative to the valve housing 10. A lower space ring 68 also maintains the retainers 62 and 64 in the proper alignment similar to an upper ring 66.

Figure 2A:
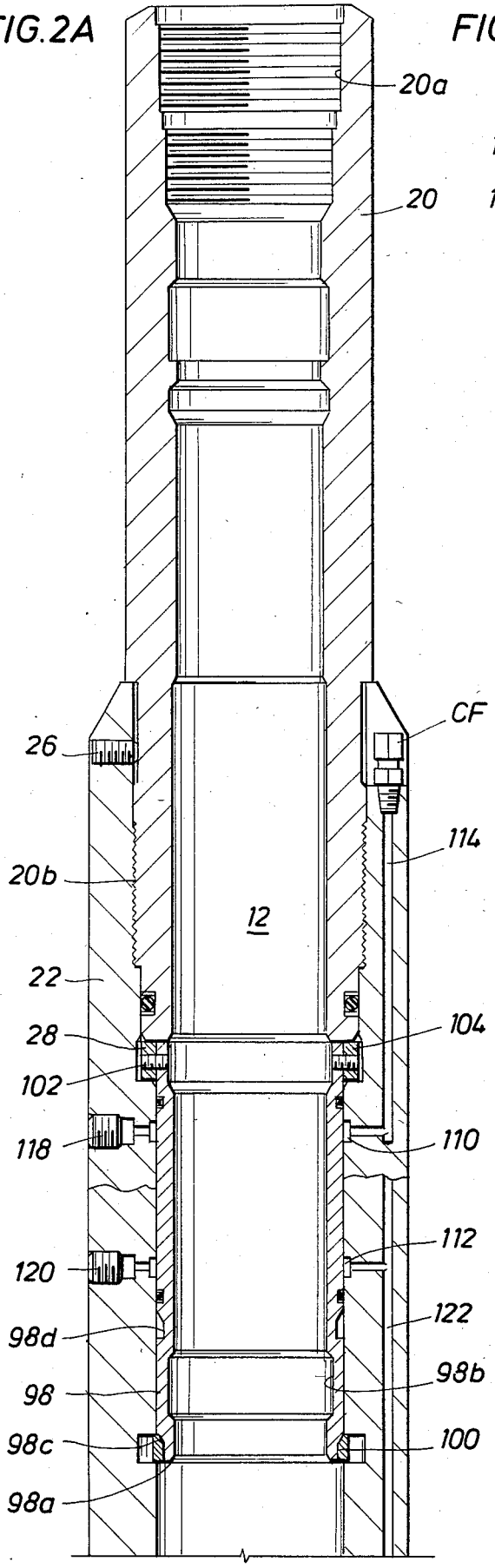
FIGS. 2A, 2B, 2C and 2D are views similar to FIGS. 1A, 1B, 1C and 1D, respectively, with the safety valve of the present invention operated to the open position.
Figure 2B:
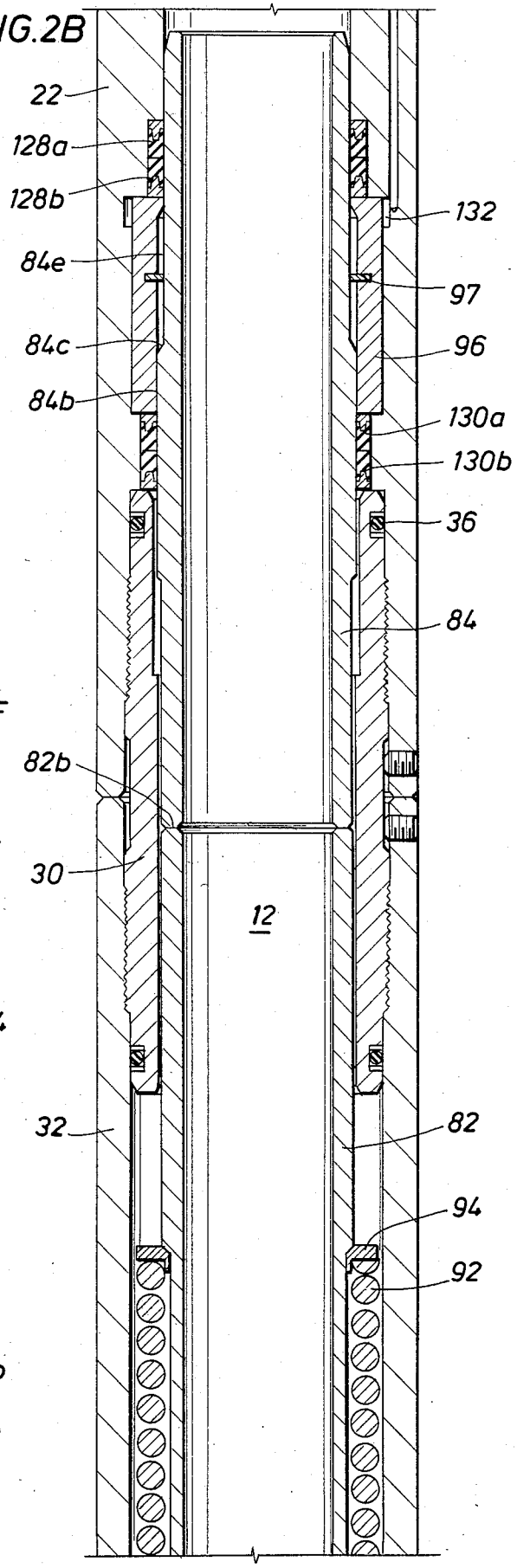
Figure 2C:
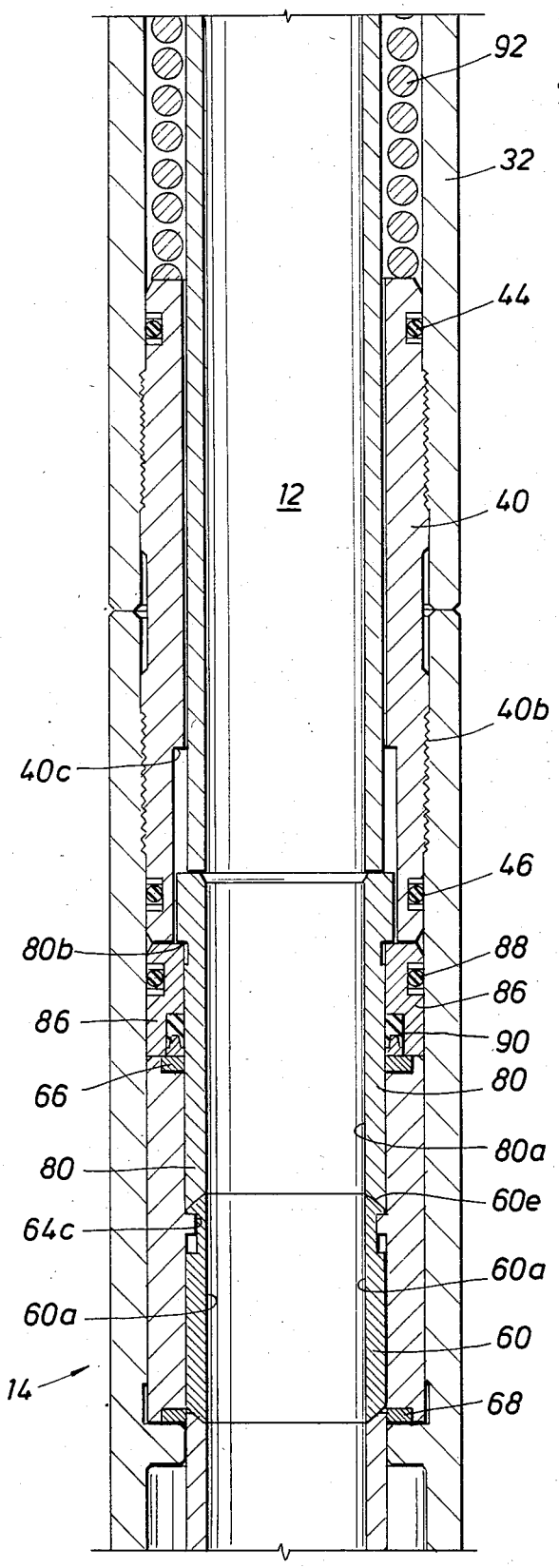
Figure 2D:
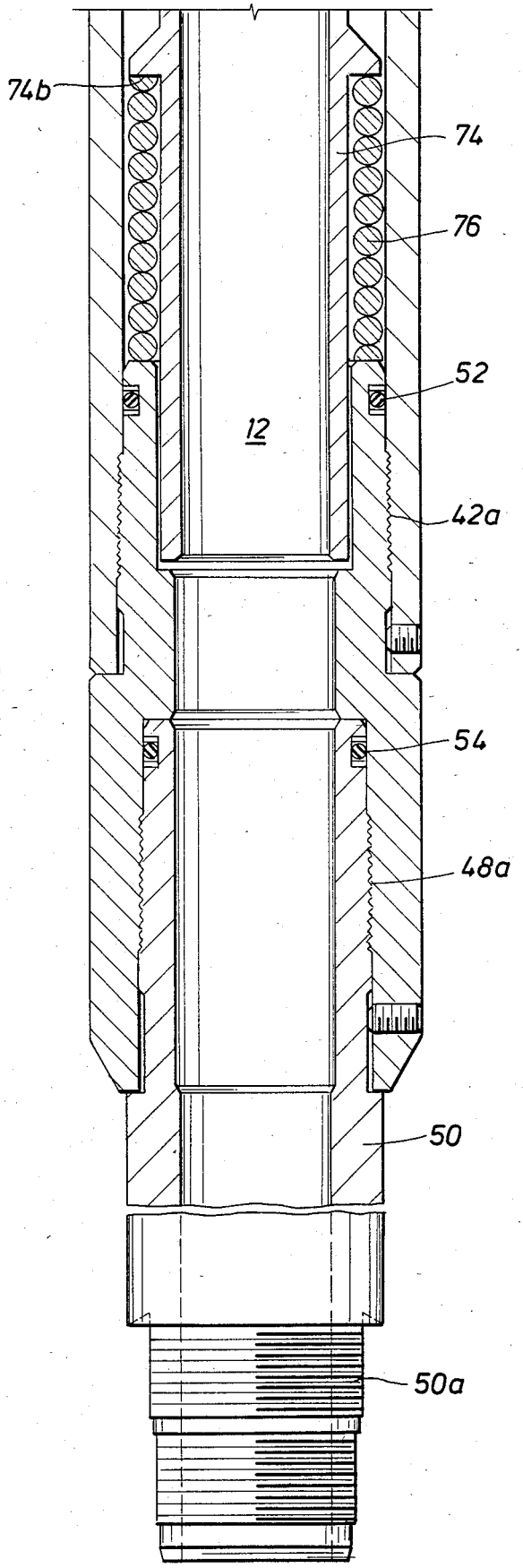

The ball-type closure element 60 includes a full flow opening or port 60*a* formed therethrough which when aligned with the bore 12 enables the desired flow of well fluids through the bore 12 (FIG. 2C). When the ball 60 is rotated to the closed position of FIG. 1C, the port 60*a* is placed out of alignment with the bore 12 and the ball 60 serves to block off the flow of well fluids in the usual manner.

The ball retainer members 62 and 64 are provided with outer cylindrical surfaces 62*a* and 64*a* for fitting tightly within the tubular lower body member 42 below the spacer ring 66 and above the collar 42*b*. The inner surfaces 62*b* and 64*b* of the ball mounting members 62 and 64 are substantially flat for placement adjacent the two parallel chordal flats 60*b* formed on the ball 60. The providing of the chordal flats 60*b* creates a clearance or openings into which the members 62 and 64 are assembled with the ball 60 prior to inserting the assembly into the sleeve 42 which is then made up with the connector sleeve 40. Each of the flat surfaces 62*b* and 64*b* of the mounting members 62 and 64 have aligned projecting eccentric ball mounting pins 62*c* and 64*c* positioned thereon which are received within the radially extending recesses 60*c* formed on each of the flats 60*b* of the ball 60 for co-acting to provide the desired cranking rotation as is well known in the art. Also formed on one or both chordal flats 60*b* is a rotational limit stop recess 60*d* (FIG. 4).

As also illustrated and described in application Ser. No. 539,333, the ball rotation limit stop recess 60*d* engages a co-acting rotational limit stop lug or lugs (not illustrated), respectively formed on the ball mounting members 62 and 64 for preventing rotational over travel of the ball 60 in response to ball movement of a longitudinal operating distance greater than the prearranged or designed stroke needed to effect the quarter turn or ninety (90) degree rotational movement to the open position. In FIG. 4, the ball 60 is positioned in the closed position with the crank pin 64*c* located below the center of the ball 60. Each of the ball crank pins 62*c* and 64*c* pivotally mounts a cam lug 70 that is slidably received within diagonal slot 60*c*. The relatively large sliding contact engagement surface between the lug 70 and the slot 60*c* substantially reduces the stress level of the contact force between these two parts during operation of the valve V. As the center of the ball 60 is moved longitudinally downwardly, the cam lugs 70 of the aligned crank pins 62*c* and 64*c* contact the surfaces formed by the radial recess 60*c* to crank the ball 60 to the fully aligned open position as illustrated in FIG. 2C.

When the ball 60 reaches the fully aligned open position, the rotation limit recess 60*d* formed on the chordal flat engages the rotational stop for preventing further rotational movement of the ball 60 which would tend to cause it to over travel the desired ninety (90) degree operating rotation. The additional undesired rotation increment would otherwise result in flow throttling with attendant downstream flow impingement and resulting erosion which could damage the safety valve V. Continued longitudinal movement of the center of the ball 60 an additional distance relative to the cam lugs 70 of crank pins 62*c* and 64*c* will move the fully open ball to the full stroke position. Note that the radially extending slot 60*c* is provided with a clearance taper at 60*e* (FIG. 4) to enable the ball 60 to move longitudinally relative to the pin 64*c* and cam lug 70 to provide for the overtravel which insures that sufficient longitudinal movement occurs to effect positive opening rotation of the ball 60.

To positively move the ball 60 longitudinally between the open and closed positions, an actuator or operator means, generally designated 16, is provided. The longitudinal movement of the ball 60 imparted by the operator means 16 co-acts with the cam lug 70 of the eccentric pins 62*c* and 64*c* to effect the desired rotational motion, previously described, to operate the valve to the desired position. The actuator means 16 includes an upper movable actuator assembly, designated 70, and a lower movable actuator assembly or mechanism, designated 72, located below the ball 60.

Figure 1D:
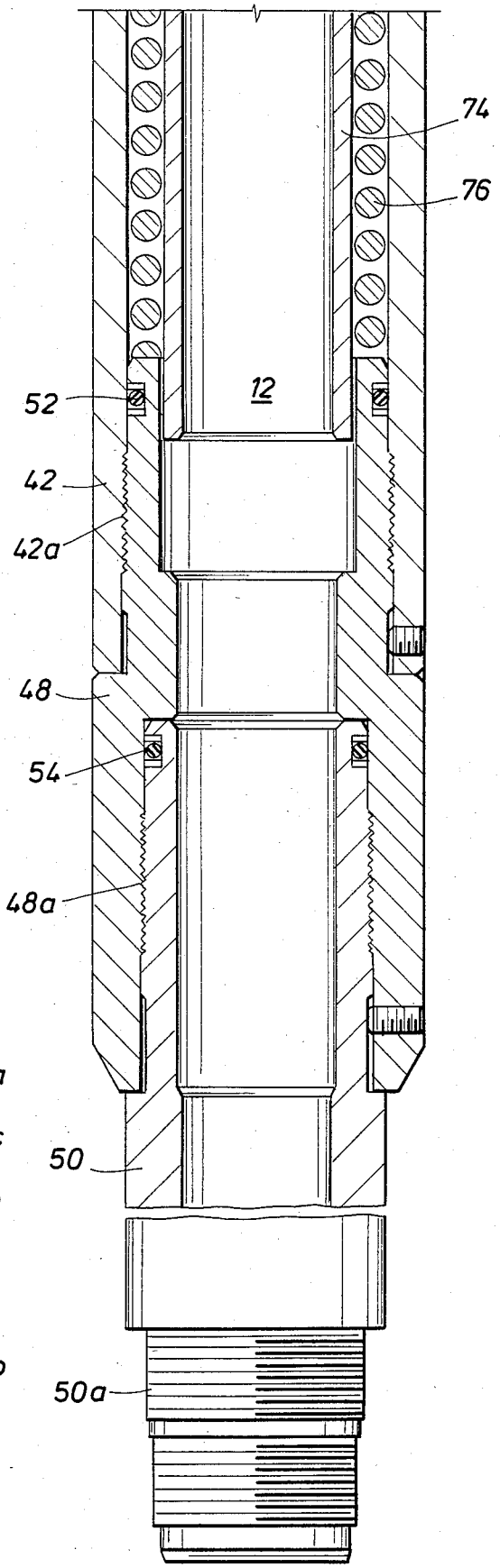

The lower actuator assembly 72 includes a lower actuator or ball follower sleeve 74 that is reciprocably mounted in the bore 12 immediately below the ball 60 (FIGS. 1C and 1D). A suitable lower biasing spring 76 provides an upwardly urging on the movable sleeve 74 to maintain the arcuate upper annular shoulder 74*a* in engagement with the ball 60 and to urge the ball 60 to the upper or rotated closed position as illustrated in FIG. 1C. The coil spring 76 is concentrically positioned outwardly of the movable sleeve 74 between the lower housing connector sleeve 48 and an annular collar 74*b* formed on the operator sleeve member 74. Preferably the strength of spring 76 is designed to return the ball 60 to the upper position while minimizing resistance to opening movement of the ball 60.

Disposed above the ball 60 is the moveable upper actuator mechanism 70. The upper actuator mechanism 70 includes reciprocating actuator sleeve assembly 78 formed by the tubular upper ball seat 80, a first tubular seat extension 82 and a second tubular seat extension 84 and which is illustrated in the upper or open position in FIGS. 1A, 1B and 1C and in the lower position in FIGS. 2A, 2B and 2C. The tubular seat 80 is provided with a downwardly facing arcuate annular shoulder 80*a* which engages the ball 60 for maintaining an annular fluid sealing contact with the outer spherical surface 60*e* of the ball 60 at all times. Alignment of the ball port 60*a* with a central flow opening 80*a* of the seat 80 enables flow through the bore 12 (FIG. 2C) while the ball 60 will block flow through the seat 80 when the ball port 60*a* is rotated out of alignment. To limit further upward movement of the seat 80 and ball 60 when the ball 60 is in the closed position, the annular seat 80 engages an annular shoulder 40*c* (FIG. 1C) of the housing connector sleeve 40.

Disposed concentrically about the seat 80 for guiding the operating movement is a fixed seal ring 86. The seal ring 86 carries an outer surface sealing O-ring 88 for sealing with the housing sleeves 42 and an inner surface seal 90 for slidably sealing with the seat 80. The inner surface seal 90 is pressure energized in response to upwardly directed flow and along with O-ring 88 blocks any such flow through the bore 12 except through the central opening 80*a* of the seat 80. These two seals plus the seal of the seat 80 with the ball 60 block all upwardly flow in the bore 12 except through the aligned port 60*a*. Engagement of a downwardly facing annular shoulder 80*b* with the seal ring 86 limits downward longitudinal travel of the seat 80 (FIG. 2C).

The first actuator seat extension 82 is urged to the upper position by a biasing spring 92 concentrically disposed between the tubular extension 82 and the housing member 32. The spring 92 is supported at its lower end by the housing connector sleeve 40 (FIG. 1C) and engages a spring retainer 94 mounted on the extension 82 below the downwardly facing tapered annular shoulder 82*a* (FIG. 1B). Preferably the upper spring 92 is made significantly stronger than the lower spring 76.

The upper actuator mechanism 78 further includes the longitudinally movable pressure responsive operator sleeve 84 (FIGS. 1A and 1B) which is disposed above the spring actuator sleeve extension 82. A downwardly facing annular shoulder 84*a* of the actuator sleeve 84 engages an upwardly facing annular shoulder 82*b* formed on the first extension 82 for forcing the extension 82, the seat 80 and the ball 60 to the lower or open position in a manner that will be explained hereinafter. The sleeve 84 is provided with a larger constant outer diameter portion 84*b* (FIG. 1B) which provides an upwardly facing annular shoulder 84*c* and downwardly facing annular shoulder 84*d*. As will be explained in greater detail hereinafter, the upwardly facing annular shoulder 84*c* forms a pressure responsive surface effective area on which control fluid pressure will urge the sleeve 84 to move downwardly for effecting opening rotation of the ball 60 when desired.

Concentrically mounted about the sleeve 82 and above the body connector 30 is a fixed seal retainer and operator guide ring 96. The guide ring 96 is tightly secured with the housing sleeve 22 below annular shoulder 22*b* and secured against downward movement by engagement with upwardly facing annular shoulder 22*c*. For assembly purposes, the guide ring 96 is longitudinally split to enable its placement between securing shoulder 22*b* and 22*c*. A gapped radial expansible ring 97 maintains the two sections of the guide ring 96 in place. The manner in which the control fluid pressure acts on sleeve 84 and particularly shoulder 84*c* will be described in greater detail hereinafter.

Disposed in the bore 12 immediately above the operator sleeve 84 is the shiftable lockout sleeve 98. The lockout sleeve 98 is longitudinally movable between the upper inoperative position (FIG. 1A) and a lower locking position (FIG. 5) where it forces the actuator sleeve 84 to the lower position and thereby effecting opening rotation of the ball 60. Thus the lockout sleeve 98 not only serves to lock the ball 60 in the open position, but also serves as back-up to open the valve V. The locking sleeve 98 is provided with a downwardly facing lower annular shoulder 98*a* which is adapted to engage the upper actuator sleeve 84 for effecting its downward movement and thereafter retaining the actuator sleeve 84 in the lower position. For shifting the lockout sleeve 98 to the lower position, a recess 98*b* is provided on the inner surface for securing to a wireline shifting tool (not illustrated). Such wireline shifting tools are well known, are commercially available from a number of sources and need not be described in greater detail herein.

The lockout sleeve 98 is provided with a downwardly facing tapered annular shoulder 98*c* which engages the gapped detent 100 for maintaining the lockout sleeve 98 in the inoperative or upper position. One or more shear pins 102 may also be employed to secure the lockout sleeve 98 with the fixed shear pin body ring 28 to also prevent inadvertent movement of the sleeve 98. When the wireline shifting tool shears pins 102 and moves the locking sleeve 98 to the lower position, the tapered surface 98*c* forces the radially expansible gapped ring or detent 100 to expand and enable passage of the lockout sleeve 98 adjacent thereto. Such movement continues until a recess 98*d* is positioned adjacent the expanded detent 100 which enables the detent 100 to move radially inwardly for locking the lockout sleeve 110 in the lower position. Because of the planned longitudinal overtravel on the seat 80, the longitudinal distance between the recess 98*d* and shoulder 98*c* is not as critical and manufacturer's tolerances may be relaxed with an expected cost savings.

The locking sleeve 98 carries O-rings 104 and 106 for effecting sliding seals between the locking sleeve 98 and the housing member 22. When the locking sleeve 98 is in the upper position, the seal 104 is positioned below the control fluid conduit ports 110 and 112 formed in the housing sleeve 22 for preventing leakage in that direction. The O-ring 106 is disposed above the ports 110 and 112 for blocking leakage of fluid between the locking sleeve 110 and the housing 22 in that direction. Fluid pressure at port 110 is communicated to the port 112 when the sleeve 98 is in the position illustrated in FIG. 1. When the sleeve 98 is shifted to the locking position of FIG. 5 there is no longer communication within ports 110 and 112 as O-ring 106 is positioned therebetween. The annular port 110 is connected by drilled passageway 114 in housing member 22 to threaded inlet 116 for connecting with the control fluid conduit CF. The control fluid conduit CF extends to the earth surface (not illustrated) for providing the control fluid operating pressure to the valve V and port 110 in the usual manner. For manufacturing and testing purposes the port 110 may be provided with a threaded opening 110*a* that is normally closed by threaded plug 118. A similar plug 120 is installed in threaded opening 112*a* of annular port 112.

During normal operation of the safety valve V, the ports 110 and 112 would be in flow communication due to the absence of a seal on the locking sleeve 110 for separating the two ports 110 and 112 and the control fluid conduit CF would also pressure the port 112. As the port 112 is connected by drilled passageway 122 with an annular port 124 disposed adjacent guide ring 96 (FIG. 1B) for communicating the fluid pressure at port 112 to port 124. In order to provide the passageway 122 it is necessary to drill opening 122*a* which is then plugged off in a suitable manner such as plug 123 (FIG. 3). The split guide ring 96 enables fluid communication from the port 124 to the upwardly forcing annular shoulder 84*c* formed on the operator sleeve 84. Thus, control fluid pressure is communicated from the earth surface through conduit CF and passage 114 to port 110. When locking sleeve 98 is in the upper inoperative position of FIG. 1A, the control fluid pressure is also communicated to port 112, passageway 122 and by annular port 124 to pressure responsive shoulder 84*c* for forcing the sleeve 84 downward and opening the ball 60. This is the normal operation mode.

When the sleeve 98 is shifted to the locking position (FIG. 5) the ball 60 is rotated open in the manner previously described. Such shifting also isolates the port 110 from the port 112 with O-ring 106, but communicates the port 110 with the bore 12 of the valve housing 10. A conventional wireline retrievable surface controlled valve (not illustrated) may then be operably installed in the bore 12 if desired and operated with the control fluid conduit CF through port 110.

Disposed above and below the guide ring 96 are a pair of oppositely facing seals 128*a*, 128*b*, 130*a* and 130*b* which seal between the housing sleeve 22 and the operator sleeve 84 at longitudinally spaced locations to define expansible chamber 132. The seals 128*a* and 128*b* are disposed above pressure responsive shoulder 84*c* while seals 130*a* and 130*b* are disposed below shoulder 84*c* for sealing on the larger outer diameter portion 84*b* of the sleeve 84. The seals 128*a* and 128*b* maintain a sliding seal with the smaller diameter outer surface 84*e* of the sleeve 84. The control fluid pressure is communicated to port 124 and therefore expansible chamber 132 urges on the annular shoulder 84*c* which is also the pressure responsive area of the sleeve 84 between the seals 128*a*, 128*b*, 130*a* and 130*b*. The increased control fluid pressure overcomes the urging of springs 92 and 76 for forcing the ball 60 to the lower open position.

The seals 128*a* and 128*b* are both pressure energized and oppositely facing. This prevents potentially damaging seal extrusion or leakage when control fluid pressure is less than well fluid pressure. Seals 130*a* and 130*b* are similarly arranged and both sets are tightly contained to also guard against extrusion while maintaining the sliding seal with the operator sleeve 84. The split guide ring 96 is dimensioned to closely fit with both outer diameters 84*b* and 84*e* of the sliding operator sleeve 84 to resist extrusion of the seals 128*a*, 128*b*, 130*a* and 130*b* under all pressure conditions encountered during operation.

USE AND OPERATION OF THE PRESENT INVENTION

The subsurface safety valve V is assembled in the manner illustrated in FIG. 1 and taken to the well site for installation in essentially that condition. At the well site, the lower threaded connector 50*a* and the upper threaded connector 20*a* are made up in the well conduit or tubing in order that the housing 10 will form a portion of the flow passage in the well at a desired subsurface location. The control fluid conduit CF is then connected to the threaded opening 116 which is then run simultaneously with the well tubing in lowering the safety valve V to its desired subsurface operating location in the well.

When it is desired to enable flow from the well, the control fluid in the conduit CF connected to threaded inlet port 116 has its pressure increased. This increased fluid pressure is communicated to the port 110 but the spaced, equal diameter seals 104 and 106 prevent any effect of this increased pressure on the locking sleeve 98. However, the increased control fluid pressure is communicated through the port 110 to port 112 and passageway 122 into port 124 and expansible chamber 132 for forcing the upper actuator sleeve 82 downward. The downward pressure force on the shoulder 82*c* of the actuator sleeve 82 overcomes the urging of the spring 92 above the ball and the spring 76 below the ball for moving the actuator sleeves downwardly. This downward movement effects the opening rotation of the ball 60 from the closed position to the rotated open position illustrated in FIG. 5 and onto the full open position.

Should the control fluid operating pressure be interrupted for any reason, the urging of the springs 76 and 92 will urge the actuator mechanism back to the upper position to provide fail-safe operation. Since the upper spring 92 is preferably made somewhat stronger than the lower spring 76, it will tend to move the sleeves 82 and 84 rapidly to the upper position. The follower lower spring 76 provides sufficient urging on the ball follower sleeve 74 to move the ball 60 and seat 80 to the upper position while maintaining the ball 60 in sealing contact with the seat 80 during closing.

When it is desired to lock the safety valve V in the open position, a wireline tool is run down the bore of the well tubing and latched into the recess 98*b* of the locking sleeve 98 in the conventional manner. After shearing pins 102 the initial downward movement of the locking sleeve 98 will radially expand the detent 100 to enable downward movement of the locking sleeve 98 and bring the annular shoulder 98*a* into engagement with the pressure responsive actuator sleeve 84. The downward movement imparted by the wireline actuation tool to the locking sleeve 98 is thereby imparted to the actuator sleeve 84 for forcing it to move downwardly and thereby effecting opening rotation of the ball 60 in the manner previously described. When the wireline operation has moved the recess 98*d* adjacent the detent 100, the detent 100 will radially contract or constrict into the recess 98*d* and prevent subsequent upward movement of the locking sleeve 98. The wireline tool may then be released from the recess 98*b* and retrieved back to the surface. A supplemental or backup wireline retrievable subsurface safety valve may be installed in the bore 12 of the safety valve V. The supplemental valve may be controlled from the surface using the control fluid passage 114 and port 110 for communicating the control fluid into the bore 12 of the safety valve V.

The foregoing disclosure and description of the invention are illustrative and explanatory thereof, and various changes in the size, shape and materials, as well as in the details of the illustrated construction may be made without departing from the spirit of the invention.

What is claimed is:

1. A subsurface safety valve apparatus for use in controlling flow in a well conduit providing a desired fluid flow path in the well for the production of well fluids, including:

a valve housing having means for connecting said valve housing in a well conduit providing the desired fluid flow path, said valve housing having a flow passage formed therethrough which communicates with the well conduit when connected therewith to form a portion of the well conduit at a desired subsurface location in the well;

flow closure means disposed in said flow passage for movement to and from a closed position for blocking flow of fluid through said flow passage and an open position for enabling flow of fluid through said flow passage;

operator means mounted with said housing for moving said flow closure means longitudinally in said flow passage to and from the open and closed positions, said operator means having an operator sleeve assembly reciprocably disposed in said bore;

said operator means having means for urging said flow closure means to the closed position;

means for sealing said operator sleeve assembly with said housing to form an expansible chamber therebetween, said operator sleeve assembly having a pressure responsive surface exposed to the fluid pressure in said expansible chamber for moving said operator sleeve assembly for moving said flow closure means to the open position;

means for selectively communicating a control fluid pressure into said expansible chamber for moving said flow closure means to the open position when desired;

said means for sealing including a first pair of seals and a second pair of seals, each of said first pair of seals being pressure energized and facing in opposite directions to prevent leakage into or out of said expansible chamber, each of said second pair of seals being pressure energized and facing in opposite directions to prevent leakage into or out of said expansible chamber; and said housing having a longitudinally split guide ring disposed between said first pair of seals and said second pair of seals for preventing extrusion of said first and second pairs of seals by fluid pressure.

2. The safety valve apparatus as set forth in claim 1, wherein:

said operator means including a lock open sleeve shiftable between an inoperative position enabling control fluid pressure operation of said operator means and a locking position for holding said flow closure means in the open position.

3. The safety valve apparatus as set forth in claim 2, wherein:

said lock open sleeve when shifted to the locking position blocking communication of said control fluid to said expansible chamber while enabling communication of said control fluid to said bore of said valve housing.

4. The safety valve apparatus as set forth in claim 1, wherein:

said flow closure means including a ball-type closure having a port extending thereto for rotational movement to and from the open position with said port aligned with said bore and a closed position with said port disposed traverse to sad bore, as said ball-type closure is reciprocated longitudinally in said bore; and said operator means having a seat with a central opening formed therethrough, sealingly engaging said ball-type closure and mounted with said housing for limited longitudinal movement relative thereto to establish the longitudinal movement of said ball-type closure relative to said housing.

5. The safety valve apparatus as set forth in claim 4, wherein:

said ball-type closure having a pair of parallel flats formed thereon, each of said flats having an operating recess formed thereon;

said housing having a pair of aligned crank pins mounted therewith, each of said crank pins rotatably mounting a cam slide with each of said cam slides disposed in one of said operating recesses formed on said flats for sliding in said recess upon longitudinal movement of said ball-type closure, said cam slides providing a larger contact area with said recesses during rotational movement of said ball-type closure to reduce the contact stress level therebetween.

6. The safety valve apparatus as set forth in claim 1, wherein:

first pair of seals and said second pair of seals effect a sliding seal with said operator sleeve assembly at different diameters; and said guide ring dimensioned to fully contain both of said pairs of seals on both of said sealing diameters to prevent their extrusion.

* * * * *